US009410093B2

(12) United States Patent
Cash et al.

(10) Patent No.: US 9,410,093 B2
(45) Date of Patent: Aug. 9, 2016

(54) HEAVY OIL HYDROCRACKING PROCESS

(71) Applicants: Dennis R. Cash, Novato, CA (US); Graham J. Forder, San Rafael, CA (US); David S. Mitchell, San Rafael, CA (US); Joel W. Rosenthal, Lafayette, CA (US)

(72) Inventors: Dennis R. Cash, Novato, CA (US); Graham J. Forder, San Rafael, CA (US); David S. Mitchell, San Rafael, CA (US); Joel W. Rosenthal, Lafayette, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 177 days.

(21) Appl. No.: 14/216,947

(22) Filed: Mar. 17, 2014

(65) Prior Publication Data

US 2014/0262943 A1 Sep. 18, 2014

Related U.S. Application Data

(60) Provisional application No. 61/851,903, filed on Mar. 15, 2013, provisional application No. 61/852,652, filed on Mar. 19, 2013.

(51) Int. Cl.

| | |
|---|---|
| ***C10G 65/12*** | (2006.01) |
| ***C10G 69/04*** | (2006.01) |
| ***C10G 69/06*** | (2006.01) |
| *C10G 65/00* | (2006.01) |
| *C10G 65/02* | (2006.01) |

(52) U.S. Cl.

CPC ..... *C10G 69/04* (2013.01); *C10G 69/06* (2013.01)

(58) Field of Classification Search

CPC ..... C10G 65/00; C10G 65/02; C10G 65/12

See application file for complete search history.

(56) References Cited

U.S. PATENT DOCUMENTS

| | | | | |
|---|---|---|---|---|
| 4,330,393 | A | 5/1982 | Rosenthal et al. | |
| 4,354,920 | A | 10/1982 | Rosenthal et al. | |
| 4,391,699 | A | 7/1983 | Rosenthal | |
| 4,422,922 | A | 12/1983 | Rosenthal et al. | |
| 4,564,439 | A | 1/1986 | Kuehler et al. | |
| 4,761,220 | A | 8/1988 | Beret et al. | |
| 4,842,719 | A | 6/1989 | Macarthur et al. | |
| 5,071,540 | A * | 12/1991 | Culross | C10G 1/00 208/413 |
| 5,246,570 | A | 9/1993 | Cronauer et al. | |
| 5,871,638 | A | 2/1999 | Pradhan et al. | |

FOREIGN PATENT DOCUMENTS

WO 2012170082 12/2012

OTHER PUBLICATIONS

International Search Report from corresponding Application No. PCT/US2014/030737 mailed Aug. 21, 2014.

* cited by examiner

*Primary Examiner* — Brian McCaig

(74) *Attorney, Agent, or Firm* — Melissa M. Hayworth; E. Joseph Gess; Susan M. Abernathy

(57) ABSTRACT

A process for the production of high yields of high quality products from heavy hydrocarbonaceous feedstock comprising a two-stage, close-coupled process. The first stage comprises a thermo-catalytic zone into which is introduced a mixture comprising the feedstock, coal, a liquid catalyst precursor, and hydrogen. The second, close-coupled stage comprises a catalytic-hydrotreating zone into which substantially all the effluent from the first stage is directly passed and processed under hydrotreating conditions.

23 Claims, 1 Drawing Sheet

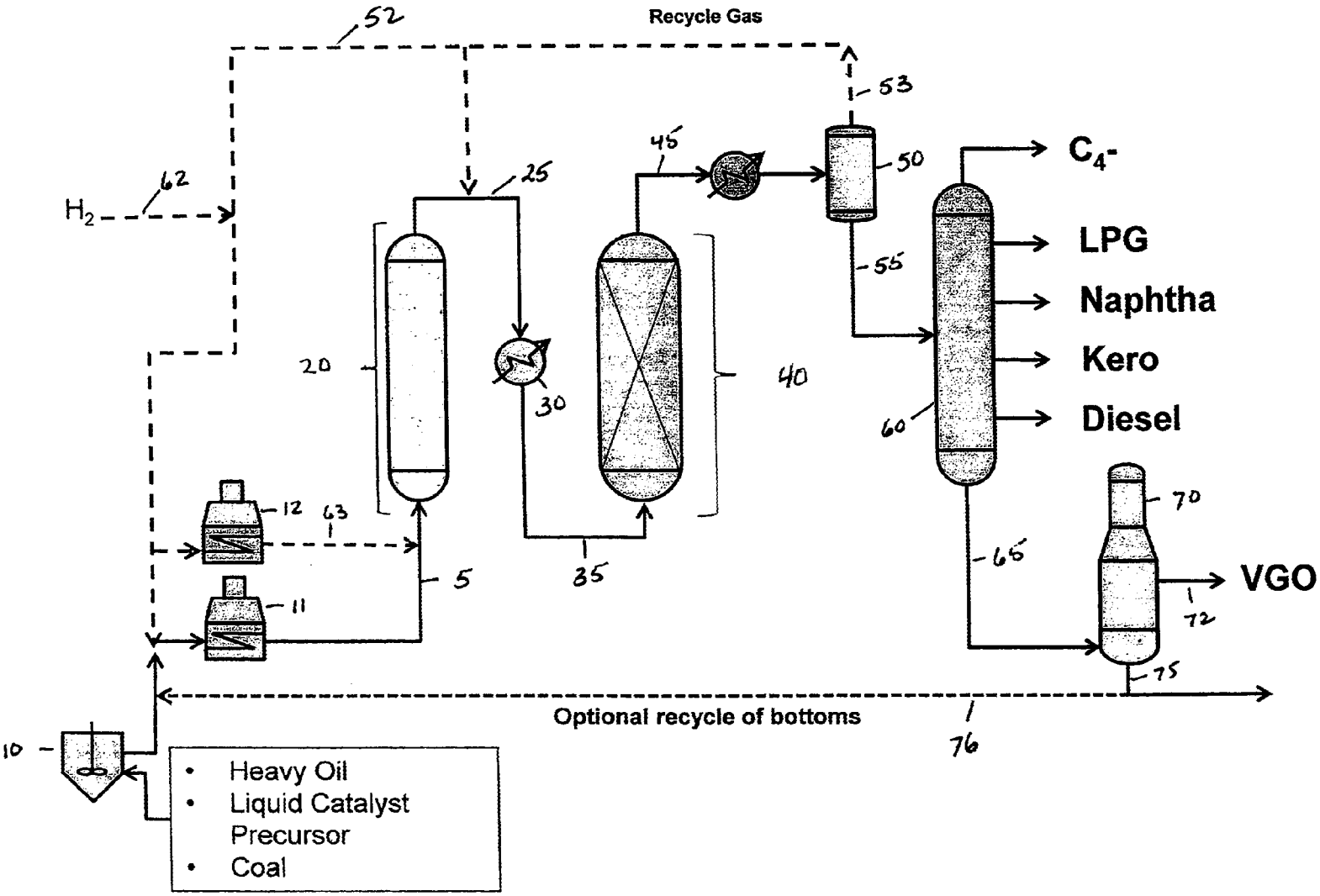
Recycle Gas
$C_4^-$
LPG
Naphtha
Kero
Diesel
VGO
Optional recycle of bottoms
$H_2$
Heavy Oil
Liquid Catalyst Precursor
Coal
10
11
12
20
25
30
35
40
45
50
52
53
55
60
62
63
65
70
72
75
76
5

HEAVY OIL HYDROCRACKING PROCESS

CROSS-REFERENCE TO RELATED APPLICATIONS

This application claims benefit of Provisional application No. 61/851,903, filed Mar. 15, 2013, and this application also claims benefit of Provisional application 61/852,652, filed Mar. 19, 2013, the contents of both of which are hereby incorporated by reference in their entirety.

BACKGROUND OF THE INVENTION

1. Field of the Invention

The present invention relates to a process for the hydroconversion of heavy hydrocarbonaceous fractions of petroleum. In particular, it relates to a close-coupled two-stage; thermo-catalytic, catalytic-hydrotreatment process for converting petroleum heavy oils that provides improved effectiveness for high conversion and control of condensation reactions to produce stable high-quality products.

2. Background

Increasingly, petroleum refiners find a need to make use of heavier or poorer quality crude feedstocks in their processing. As that need increases, the need also grows to process the fractions of those poorer feedstock's boiling at elevated temperatures, particularly those temperatures above 1000° F. High conversions to stable, quality products are desirable in order to avoid producing significant quantities of low value fuel oil. Delayed coking, the refiner's traditional solution for converting heavy oils to liquid products, has become less attractive because of the low conversion to liquid products and the relatively low value of the coke by-product. Higher liquid conversions can be achieved with conventional ebullated bed technologies. But these technologies, even with enhancements such as solvent de-asphalting, suffer limitations due to the instability of the fuel oil product and refractive nature of the products—making further upgrading difficult.

Severe conditions are required in order to achieve high conversions which, while producing desirable lighter fractions, can also produce thermally cracked fragments and unstable asphaltenes that form mesophase masses. Unless controlled, the cracked fragments undergo condensation reactions to undesirable polycyclic molecules which tend to be unstable and difficult to process into desirable products. Along with the mesophase masses, they can also lead to coke formation.

The key to high conversion and product quality is the management of the asphaltenes which are produced at severe operating conditions. Current approaches have focused on slurry reactor technology utilizing sophisticated dispersed catalyst systems, in some cases employing molybdenum. These technologies tend to have high investment and operating costs and, in some cases, product quality remains an issue. Many of these processes also have difficulties if the metals content of the feedstock is high.

Various processes for the conversion of heavy hydrocarbonaceous fractions, particularly, multi-stage conversion processes include those described in U.S. Pat. No. 4,761,220, Beret, et al.; U.S. Pat. No. 4,564,439, Kuehler, et al.; U.S. Pat. No. 4,330,393, Rosenthal, et al.; U.S. Pat. No. 4,422,922, Rosenthal, et al.; U.S. Pat. No. 4,354,920, Rosenthal, et al; U.S. Pat. No. 4,391,699, Rosenthal, et al.

SUMMARY

The present invention relates to a process for converting the portion of heavy oil feedstock boiling above 1000° F. High yields of high quality products boiling below 1000° F. are obtained. Compared to existing processes, the products are reduced in heteroatom content, reduced in condensed molecules and are more readily processed to finished fuels.

The process comprises introducing a mixture comprising heavy oil feedstock, coal and a liquid catalyst precursor, into a first-stage thermo-catalytic zone. The liquid catalyst precursor converts into very fine catalyst particles under the conditions in the thermo-catalytic zone. The particles obtained from the liquid catalyst precursor are smaller than those provided by grinding solid thermo-catalytic materials. These very fine catalyst particles obtained from the conversion of the liquid catalyst precursor greatly minimizes the impact of solids in any subsequent zone.

The mixture, including the liquid catalyst precursor, is introduced into the thermo-catalytic zone along with hydrogen. The thermo-catalytic zone is operated at elevated temperature and pressure. The feedstock, coal and liquid catalyst precursor mixture is introduced into the thermo-catalytic zone under conditions sufficient to convert a significant amount of hydrocarbons in the feedstock boiling above 1000° F. to hydrocarbons boiling below 1000° F.

In one embodiment, substantially all of the thermo-catalytic zone gaseous, liquid and solid effluent is passed directly, in a close-coupled manner, into a second stage catalytic-hydrotreating zone with inter-zone cooling to reduce temperature prior to the second stage zone. The first zone effluent is contacted with hydrotreating catalysts under hydrotreating conditions, and the effluent from catalytic-hydrotreating reaction zone is recovered.

In another embodiment a portion of the gaseous products from the first stage thermo-catalytic zone is removed. In this embodiment, substantially all of the thermo-catalytic zone liquid and solid effluent is passed directly, in a close-coupled manner, into a catalytic-hydrotreating reaction zone with inter-zone cooling to reduce temperature prior to the second stage zone. As in the first embodiment, the first zone effluent is contacted with hydrotreating catalysts under hydrotreating conditions, and the effluent from catalytic-hydrotreating reaction zone is recovered.

BRIEF DESCRIPTION OF THE FIGURE OF THE DRAWING

FIG. 1 is a schematic flow diagram of one embodiment of the process of the present invention.

DETAILED DESCRIPTION

The present invention provides a process for the hydroconversion of heavy oil feedstocks that effectively controls asphaltene condensation by utilization of a combination of dispersed coal, dispersed catalyst, and a two-stage close-coupled thermo-catalytic reactor/catalytic-hydrotreating reactor configuration. It converts heavy hydrocarbonaceous feed-stocks, a significant portion of which boils above 1000° F., to high yields of high quality products boiling below 1000° F.

The dispersed catalyst is obtained in the present process by utilizing a liquid catalyst precursor. The liquid catalyst precursor can be a solution of dissolved catalyst material, dissolved in either an aqueous or organic solvent. Among the preferred liquid catalyst precursors is a molecule comprising molybdenum, such as molynaphthanate. It is important that the liquid catalyst precursor, under the conditions of elevated temperature and pressure in the thermo-catalytic zone, convert to a solid, e.g., come out of solution as a solid. The result is a solid catalyst particle of extremely small size which is quite effective as a catalyst, but also quite beneficial to subsequent reaction zones.

The liquid catalyst precursor is mixed with a heavy oil feedstock and coal and introduced into the thermo-catalytic zone with hydrogen. Under the conditions in the thermo-catalytic zone, generally elevated temperature and pressure, the liquid catalyst precursor is converted into very fine catalyst particles. The liquid catalyst precursor material comes out of solution under the conditions of the reactor in the form of very small, fine catalyst particles. These catalyst particles obtained are generally smaller than those obtained upon grinding solid thermo-catalytic particles. The smaller catalyst particles obtained upon the conversion in the thermo-catalytic zone allows for improved dispersion of the catalyst. Since the liquid was well dispersed in the heavy oil feedstock, the solid catalyst particles will also be well dispersed upon formation. The small particles also minimize the impact of solids on the hydrotreating zone. This is particularly true when using a fixed-bed hydrotreating zone. The present invention, therefore, creates a more trouble-free environment for using fixed-bed second zone (hydrotreating) reactors, while also effectively controlling asphaltene condensation and providing efficient stabilization of unstable compounds. Although moving beds and ebullating beds are more tolerant than fixed beds to the presence of solids, they also will benefit from the use of a liquid catalyst precursor in accordance with the present invention due to the very fine particle size and resulting improved activity and dispersion of the catalyst.

The process, in one embodiment, is a two-stage, close-coupled process, the first stage of which encompasses a thermo-catalytic zone, wherein the feedstock is substantially converted to lower boiling products. The product of the thermo-catalytic zone is cooled somewhat and passed directly, without substantial loss of hydrogen partial pressure, into a catalytic-hydrotreating zone, where the thermo-catalytic zone effluent is hydrotreated to produce hydrotreated products suitable for further treatment into transportation fuels and other products. In the thermo-catalytic zone, the dispersed catalyst, obtained upon conversion of the liquid catalyst precursor, catalyses the hydrogenation of thermally cracked fragments and stabilizes them thus preventing condensation reactions. The dispersed catalyst also hydrogenates coal liquids, which coal liquids in a non-catalytic process also act to hydrogenate thermally cracked fragments by donating hydrogen to them. The coal liquids also act to solubilize asphaltenes and asphaltenes precursors and inhibit the formation of mesophase masses. The close-coupled catalytic-hydrotreater plays a key role in promptly stabilizing remaining thermally cracked fragments from the first stage, hydrogenating products, removing heteroatoms and effecting some further molecular weight reduction. The unconverted coal and coal ash sequester the metals in the feedstock in the first stage thermo-catalytic zone which results in substantial reduction of metals fouling of the supported hydrotreating catalyst in the catalytic-hydrotreating zone.

Thermo-catalytic cracking tends to produce unstable products. This can lead to both the fouling of downstream equipment and the production of poor quality products. Placing the lower temperature catalytic-hydrotreating zone directly after the thermo-catalytic zone (in a single high pressure loop) assures the prompt saturation of unstable molecules that were created in the thermo-catalytic reactor. In contrast to conventional processing, which places separation steps after the thermo-catalytic reactor, and does not directly pass the liquids and liquids/solids from the thermo-catalytic zone to a catalytic-hydrotreating zone, this prompt stabilization significantly reduces the polymerization of unstable molecules to form undesirable asphaltenes. Thus, the zones are "close-coupled". Close-coupled then, refers to the connective relationship between these zones. The pressure between the thermo-catalytic zone and the catalytic-hydrotreating zone is maintained such that there is no substantial loss of hydrogen partial pressure. In a close-coupled system also, there is no separation of solids from liquids as the thermo-catalytic effluent passes from one zone to the other, and there is no more cooling and reheating than necessary. However, it is preferred to cool the first-stage effluent by passing it through a cooling zone prior to the second stage. This cooling does not affect the close-coupled nature of the system. The cooling zone will typically contain a heat exchanger or similar means, whereby the effluent from the thermo-catalytic reactor zone is cooled to a temperature less than 800° F., e.g., between 600-790° F., in order to reach a temperature suitable for hydrotreating without excessive fouling of the hydrotreating catalyst in the catalytic-hydrotreater. Some cooling may also be effected by the addition of a fresh, cold, hydrogen-rich stream.

Feedstocks finding particular use within the scope of this invention are heavy hydrocarbonaceous feedstocks, at least 30 volume percent, preferably 50 volume percent of which boils above 1000° F. Examples of typical feedstocks include crude petroleum, topped crude petroleum, reduced crudes, petroleum residua from atmospheric or vacuum distillations, solvent deasphalted tars and oils, and heavy hydrocarbonaceous liquids including residua derived from coal, bitumen, or coal tar pitches. Herein, these feedstocks are referred to as "heavy oil". Other feedstocks such as vacuum gas oils, coker gas oils, and FCC cycle oils may also be favorably co-processed with these heavy oils.

Coal is also added to the feed mixture to the thermo-catalytic zone. The coal acts as a promoter and an absorbent for heavy oil metals. A low dose of bituminous coal, for example, from about 5-10 wt % of the total feed, is suitable and effective. Larger or smaller amounts can also be effectively used.

The process of the invention may be more fully understood by reference to FIG. 1, which illustrates one embodiment of the invention. Heavy oil feedstock (hydrocarbonaceous feedstocks, a significant portion of which boils above 1000° F.) enters the process by line 5. At least some portion of the feed is mixed (mixer 10) with finely divided coal and liquid precursor to disperse the coal and catalyst in the heavy oil. Hydrogen is introduced via conduits 62 and 63, and constitutes fresh hydrogen via conduit 62, recycled gases via conduit 52 or mixtures thereof. It is an essential feature of this invention that the added coal and liquid catalyst precursor be highly dispersed. The added coal and dispersed liquid catalyst precursor are mixed in mixing zone 10 with feed to form a slurry, preferably a dispersion or uniform distribution of particles within the feed, which is introduced into a first-stage thermo-catalytic reactor 20 via conduit 5. Coal is added in the mixture in a concentration relative to the feedstock from 0.5 to 40 percent by weight, preferably 0.5 to 20 percent by weight and more preferably from about 3 to 10 percent by weight. About 3 to 10 percent coal addition will be suitable for most feeds and operations. High volatile bituminous coals are preferred due to their high hydroaromatic content and ease of liquefaction, but coals of other rank may be suitable. The coal particles must be finely divided, having a maximum diameter of about 40 mesh U.S. sieve series, preferably smaller than 100 mesh and more preferably under 10 microns.

Prior to introduction into the first-stage thermo-catalytic zone, the feedstock slurry and hydrogen-containing streams are heated at 11 to provide an operating temperature of between 750° F. to 900° F., preferably 800° F. to 875° F., in the zone. This heating may be done to the entire feed to the zone at 11 or may be accomplished by segregated heating of the various components or combinations of the components of the total feed (for example, feed-solids slurry, feed-gas mixture, feed only, gas only). Hydrogen added to the thermo-catalytic zone can also be heated, e.g., at 12.

The heated combined oil, hydrogen-rich gas, coal and catalyst pass by line 5 to an upflow thermo-catalytic slurry reactor 20 and out by conduit 25 to cooling means 30 and by conduit 35 to hydrotreating reactor 40. Hydrogen-rich gas may be added, if desired. In addition to cooling the thermo-catalytic effluent stream, this gas addition will result in higher hydrogen partial pressure and lead to more efficient usage of the hydrotreater catalyst.

The short route of products from reactor 20 to reactor 40 helps to minimize asphaltene and mesophase production. However, in some embodiments, it may be desirable to remove a portion of the gas that is present in the thermo-catalytic zone. Since small quantities of water and light gases are produced in the thermo-catalytic zone, the catalyst in the catalytic-hydrotreating zone may be subjected to a slightly lower hydrogen partial pressure than if these materials were absent. Thus, in this embodiment, effluent from reactor 20 can pass to a separator, not shown. Gas can be separated and removed, and the bottoms passed to the catalytic-hydrotreating zone. Furthermore, this inter-stage removal of the carbon monoxide and other oxygen-containing gases may reduce the hydrogen consumption in the catalytic-hydrotreating stage. The removal of all or a portion of the gas from the thermo-catalytic zone might also be done to provide improved hydrodynamics in the downstream catalytic-hydrotreating zone. In any case, the removal of gas is to be done in a manner that does not cause significant delay in the movement of solids-containing liquids from the thermo-catalytic zone to the catalytic-hydrotreating zone where the process conditions are more favorable for the stabilization of heavy hydrocarbon molecules. The hydrogen-rich gas stream recovered from the separator may be treated and recycled to the thermo-catalytic or catalytic-hydrotreating zones.

Effluent from reactor 40 passes by conduit 45 to separator 50 where the gas phase is separated from the liquid/solids phase. The gas phase (conduit 53) may be treated and recycled back to the thermo-catalytic and/or the catalytic-hydrotreating zone. The liquid/solids bottoms from the separator 50 passes by conduit 55 to atmospheric distillation column 60 where gases and and liquid fractions are removed as schematically shown. In operation several streams of different boiling range products may be separately removed. The bottoms stream (conduit 65) is further distilled in vacuum column 70 to separate a vacuum distillate product (conduit 72) from a solids-containing vacuum bottoms stream (conduit 75). In some cases it may be desirable to recycle all or a portion of these streams back to the feed system via conduit 76.

Other reaction conditions in the thermo-catalytic zone include residence time of from 0.5 to 3 hours, preferably 0.5 to 1.5 hours; a hydrogen partial pressure in the range of 35 to 300 atmospheres, preferably 100 to 200 atmospheres, and more preferably 100 to 175 atmospheres; and a hydrogen gas rate of 350 to 3000 liters per liter of feed mixture and preferably 400 to 2000 liters per liter of feed mixture. Under these conditions, a significant amount of the hydrocarbons in the feedstock boiling above 1000° F. is converted to hydrocarbons boiling below 1000° F. In this invention, the percentage of hydrocarbons boiling above 1000° F. converted to those boiling below 1000° F. are at least 50 percent, more preferably 75 percent and most preferably more than 90 percent.

Once the liquid catalyst precursor is converted to fine catalyst particles, the solid reaction dispersed catalyst is present in the reaction mixture in the thermo-catalytic reactor in a concentration relative to the total feedstock of from about 0.1 to 5 percent by weight, preferably 0.5 to 1 percent by weight. The dispersed catalyst particles are not supported on a base material since they have been converted to a solid catalyst particle in the thermo-catalytic reactor from the liquid catalyst precursor solution. The particles should be finely divided, having a maximum diameter of about 40 mesh U.S. sieve series or less, and preferably smaller than 100 mesh, and most preferably less than 10 microns.

The catalytic-hydrotreating reaction zone may be a fixed, ebullating, or moving bed all of which are well known to those skilled in the art.

In the catalytic-hydrotreating reaction zone, predominately hydrogenation occurs which further stabilizes unstable molecules from the thermo-catalytic zone and also removes heteroatoms such that the product will also have been substantially desulfurized, denitrified, and deoxygenated. Some cracking also occurs simultaneously, such that some higher-molecular-weight compounds are converted to lower-molecular-weight compounds.

Catalyst used in the catalytic-hydrotreating zone may be any of the well-known, commercially available hydroprocessing catalysts. A suitable catalyst for use in this reaction zone comprises a hydrogenation component supported on a suitable refractory base. Suitable bases include silica, alumina, or a composite of two or more refractory oxides. Suitable hydrogenation components are selected from Group VI-B metals, Group VIII metals and their oxides, sulfides or mixture thereof. Particularly useful are cobalt-molydenum, nickel-molybdenum, or nickel-tungsten.

In the catalytic-hydrotreating zone, it is preferred to maintain the temperature below 800° F., preferably in the range of 600° F. to 800° F., and more preferably between 650° F. to 780° F. to prevent catalyst fouling. Other hydrocatalytic conditions include a hydrogen partial pressure from 35 atmospheres to 300 atmospheres, preferably 100 to 200 atmospheres, and more preferably 100 to 175 atmospheres; a hydrogen flow rate of 300 to 1500 liters per liter of feed mixture, preferably 350 to 1000 liters per liter of feed mixture; and a residence time in the range of 0.3 to 4 hours, preferably 0.5 to 3 hours.

Typical heavy hydrocarbonaceous feedstocks of the kind that find application in the process of this invention often contain undesirable amounts of metallic contaminants. Unless removed, these contaminants can result in deactivation of the second-stage hydrotreating catalyst, and/or plugging of the catalyst bed resulting in an increase in the pressure drop in the bed of supported hydrotreating catalyst. The present invention is well suited for the processing of feeds that are high in metallic contaminants because most of these contaminants are removed from the feed and deposited on undissolved coal and ash. If a relatively low amount of coal is used or if the coal is insufficient in un-dissolved coal and/or ash, additional coal ash may be added to aid in metals removal. The present invention is also particularly well suited for feeds that are derived from crudes that are high in residuum content, especially those that are also high in contaminants, since high quality products can be obtained from these lower cost crudes.

The process of the present invention produces liquid products, a significant portion of which boils below 1000° F. and which are suitable for processing to transportation fuels. The normally liquid products, that is, all of the product fractions boiling above $C_4$, have a specific gravity in the range of naturally occurring petroleum stocks. Additionally, relative to the feed, the total product will have at least 80 percent of sulfur removed and at least 30 percent of nitrogen removed. Products boiling in the transportation fuel range may require additional upgrading prior to use as a transportation fuel.

The process is operated at conditions and with sufficient severity to convert at least fifty (50) percent of the heavy oil feedstock boiling above 1000° F. to products boiling below 1000° F., and preferably at least seventy-five (75) percent conversion and more preferably to at least ninety (90) percent conversion.

In this specification and drawing, the invention has been described with reference to specific embodiments. It will, however, be evident that various modifications and changes can be made thereto without departing from the broader spirit and scope of the invention as set forth in the appended claims. The specification is, accordingly, to be regarded in an illustrative rather than a restrictive sense. Therefore, the scope of the invention should be limited only by the appended claims.

What is claimed is:

1. A process for conversion of heavy oils to produce lower boiling hydrocarbon products comprising;

dispersing finely divided coal and a liquid catalyst precursor in a heavy oil feedstock, heating and passing the dispersed mixture together with hydrogen to a first reaction zone in which the liquid catalyst precursor is converted into fine solid catalyst particles, reducing the product of the first reaction zone in temperature and passing the product to a second reaction zone having a supported hydrotreating catalyst, with the first and second reaction zone close-coupled, the first reaction zone a thermo-catalytic reactor(s) and the second reaction zone a catalytic-hydrotreating reactor(s); and recovering the product of the second reaction zone.

2. The process of claim 1, wherein substantially all effluent from the thermo-catalytic zone is passed into the catalytic-hydrotreating zone.

3. The process of claim 1, wherein some gaseous product is removed from the product of the thermo-catalytic reactor before passing to the catalytic-hydrotreating reactor.

4. The process of claim 1, wherein the liquid catalyst precursor is comprised of a molybdenum compound.

5. The process of claim 4, wherein liquid catalyst precursor comprises a solution of a dissolved catalyst material comprising molybdenum naphthenate.

6. The process of claim 5, wherein the liquid catalyst precursor material is dissolved in an organic solvent.

7. The process of claim 1, wherein the temperature of said first-reaction thermo-catalytic zone is maintained within a range of between 750° F. to 900° F.

8. The process of claim 1, wherein the products from the catalytic-hydrotreating reactor are separated into gaseous, liquid and a liquid/solid bottom fractions and wherein a portion of the liquid and/or liquid/solid fraction bottoms is recycled back to the feed system.

9. The process of claim 1, wherein the products from the catalytic-hydrotreating zone are separated into gaseous and liquid/solid bottom fractions and wherein a portion of the gaseous fraction containing hydrogen is recycled to the hydrotreating reaction zone.

10. The process of claim 1, wherein the products from the catalytic-hydrotreating zone are separated into gaseous and liquid/solid bottom fractions and wherein a portion of the gaseous fraction containing hydrogen is recycled to thermo-catalytic reaction zone.

11. The process as claimed in claim 1, wherein the temperature of the catalytic-hydrotreating zone is between 600° F. to 790° F.

12. The process as claimed in claim 1, wherein the amount of heavy oil in the feedstock is converted to hydrocarbons boiling below 1000° F. is at least 50 percent.

13. The process as claimed in claim 1, wherein the amount of heavy oil in the feedstock is converted to hydrocarbons boiling below 1000° F. is preferably at least 75 percent.

14. The process of claim 1 wherein said heavy oil feedstock is selected from the group consisting of crude petroleum, topped crude petroleum, reduced crudes, petroleum residua from atmospheric or vacuum distillations, solvent deasphalted tars and oils, heavy hydrocarbonaceous liquids derived from coal, bitumen, or coal tar pitches.

15. The process of claim 1, wherein said heavy oil feedstock is co-processed with oils such as VGO, Coker Gas Oil, and/or FCC Cycle Oil.

16. The process of claim 1, wherein the concentration of coal dispersed in the feed to the thermo-catalytic zone is between 0.5 and 40 percent by weight.

17. The process as claimed in claim 1, wherein the concentration of coal dispersed in the feed to the thermo-catalytic zone is about 3 to 10 percent by weight.

18. The process of claim 1, wherein the amount of solid catalyst in the thermo-catalytic zone once the liquid catalyst precursor is converted to fine catalyst particles is from about 0.1 to 5 percent by weight in relation to the total feedstock to the thermo-catalytic zone.

19. The process of claim 1, wherein the residence time of the material in the thermo-catalytic reaction zone is from about 0.5 to 3 hours.

20. The process of claim 1, wherein the residence time of material in the second reaction zone is from about 0.3 to 4 hours.

21. The process as claimed in claim 1, wherein the supported catalyst in said catalytic-hydrotreating zone is maintained in a fixed, ebullated or moving bed(s) within the reaction zone.

22. The process as claimed in claim 1, wherein the process in the second reaction zone is maintained at a hydrogen partial pressure from about 35 atmospheres to 300 atmospheres.

23. The process as claimed in claim 1, wherein said metal contaminants in the feedstock include nickel, vanadium, and iron and where they are substantially removed from the feedstock in the thereto-catalytic stage.

* * * * *